US010145123B2

(12) United States Patent
Ahn et al.

(10) Patent No.: US 10,145,123 B2
(45) Date of Patent: Dec. 4, 2018

(54) OUTER-WALL HEAT-INSULATING FINISHING MATERIAL

(71) Applicant: JEONGYANG SG CO., LTD., Gongju-si (KR)

(72) Inventors: Byung Kwun Ahn, Daejeon (KR); Young Jong Yoo, Hwaseong-si (KR); Sang Hee An, Daejeon (KR)

( * ) Notice: Subject to any disclaimer, the term of this patent is extended or adjusted under 35 U.S.C. 154(b) by 0 days.

(21) Appl. No.: 15/740,010

(22) PCT Filed: Dec. 4, 2015

(86) PCT No.: PCT/KR2015/013264
§ 371 (c)(1),
(2) Date: Dec. 27, 2017

(87) PCT Pub. No.: WO2017/026589
PCT Pub. Date: Feb. 16, 2017

(65) Prior Publication Data

US 2018/0163409 A1 Jun. 14, 2018

(30) Foreign Application Priority Data

Aug. 7, 2015 (KR) ..... 10-2015-0111364

(51) Int. Cl.
*E04F 13/08* (2006.01)
*E04B 1/76* (2006.01)
(Continued)

(52) U.S. Cl.
CPC ..... *E04F 13/0862* (2013.01); *E04B 1/76* (2013.01); *E04B 1/7629* (2013.01);
(Continued)

(58) Field of Classification Search
CPC ... E04F 13/0862; E04F 13/0885; E04F 13/14; E04B 1/7637; E04B 1/7629; E04B 1/80
See application file for complete search history.

(56) References Cited

U.S. PATENT DOCUMENTS 4,011,702 A * 3/1977 Matyas ..... E04F 13/0862 52/387
4,809,470 A * 3/1989 Bauer ..... E04F 13/0801 52/105
(Continued)

FOREIGN PATENT DOCUMENTS

JP 2000-336890 12/2000
JP 2002-339468 11/2002
(Continued)

OTHER PUBLICATIONS

English specification of 10-2011-0009307.
(Continued)

*Primary Examiner* — Jeanette E Chapman
(74) *Attorney, Agent, or Firm* — Antonio Ha & U.S. Patent, LLC

(57) ABSTRACT

The present invention relates to a heat-insulating finishing material and, more particularly, to an outer-wall heat-insulating finishing material configured such that tiles can be arranged on the heat-insulating material at a predetermined interval using an interval plate, by applying mortar to the bottom surface and the upper, lower, left, and right surfaces of the tiles, the tiles can be firmly attached to the surface of the heat-insulating material, and, by means of a change in shape of the interval plate and an intaglio pattern formed on the surface of the heat-insulating material, the tiles, which are fitted to the interval plate and attached to the surface of the heat-insulating material, can remain attached, with a maximized attaching force, regardless of various external forces.

7 Claims, 6 Drawing Sheets

(51) Int. Cl.
*E04B 1/80* (2006.01)
*E04F 13/14* (2006.01)

(52) U.S. Cl.
CPC ..... *E04B 1/7637* (2013.01); *E04B 1/80* (2013.01); *E04F 13/0878* (2013.01); *E04F 13/0885* (2013.01); *E04F 13/142* (2013.01); *E04F 13/14* (2013.01)

(56) References Cited

U.S. PATENT DOCUMENTS 5,590,500 A * 1/1997 McCue ..... A47B 96/18 52/311.2
5,822,937 A * 10/1998 Mahony ..... E04F 13/0801 52/366
7,121,051 B2 * 10/2006 Hunsaker ..... E04F 13/0862 52/314
8,627,625 B2 * 1/2014 Bouchard ..... E04F 13/0862 52/387

FOREIGN PATENT DOCUMENTS

| | | |
|---|---|---|
| KR | 10-0632270 | 10/2006 |
| KR | 10-2011-0009307 | 1/2011 |
| KR | 10-1461545 | 11/2014 |
| KR | 10-1462841 | 11/2014 |

OTHER PUBLICATIONS

English specification of 10-0632270.
English abstract of 2000-336890.
English abstract of 2002-339468.
English specification of 10-1461545.
English specification of 10-1462841.

* cited by examiner

OUTER-WALL HEAT-INSULATING FINISHING MATERIAL

CROSS-REFERENCE TO RELATED APPLICATIONS

This patent application is a national-stage application of International Patent No. PCT/KR2015/013264, filed on Dec. 4, 2015, which claims priority under 35 U.S.C. § 119 to Korean Patent Application No. 10-2015-0111364, filed on Aug. 7, 2015, in the Korean Intellectual Property Office, the disclosure of which is incorporated by reference herein in its entirety.

TECHNICAL FIELD

The present invention relates to a heat-insulating finishing material and, more particularly, to an outer-wall heat-insulating finishing material configured such that tiles can be arranged on the heat-insulating material at a predetermined interval using an interval plate, by applying mortar to the bottom surface and the upper, lower, left, and right surfaces of the tiles, the tiles can be firmly attached to the surface of the heat-insulating material, and, by means of a change in shape of the interval plate and an intaglio pattern formed on the surface of the heat-insulating material, the tiles, which are fitted to the interval plate and attached to the surface of the heat-insulating material, can remain attached, with a maximized attaching force, regardless of various external forces.

BACKGROUND ART

Generally, a building is finished with heat insulation along its outer walls. A finish is applied to the surface of the heat insulation to reinforce the outer walls and to simply the construction.

Applying mortar to the surface of heat insulation followed by attaching a finish may, however, result in a misalignment and lowered adhesion of the finish.

In relation to this, Korean Patent No. 10-1462841, titled "heat insulation-combined brick spacer and masonry wall construction using the same" discloses a technique for constructing heat insulation in which interval plates are placed on a heat insulating material and a finish is fitted into the interval plates.

According to this, the interval plates are horizontally connected, and the finish disturbs connections in upper, lower, left, and right directions via mortar. Thus, this scheme suffers from deteriorated adhesion.

Moreover, the finish may not remain attached for a long time against various external forces.

PRIOR TECHNICAL DOCUMENTS

Patent Documents (Patent Document 1) KR10-1462841 B1

SUMMARY

An object of the present invention is to provide an outer-wall heat-insulating finishing material in which tiles may be arranged at constant intervals on a heat-insulating material via interval plates, the tiles may be fitted between the interval plates, mortar is applied onto the upper, lower, left, and right side surfaces, as well as the bottoms, of the tiles so that the tiles are connected with their upper, lower, right, and left tiles, allowing the tiles to be securely attached to the surface of the heat-insulating material.

Another object of the present invention is to provide an outer-wall heat-insulating finishing material in which the shape of the interval plates is changed to maximize the area of attachment with the mortar, increasing the area where the tiles attach to the interval plates and resultantly allowing for an increased grip for the tiles.

Still another object of the present invention is to provide an outer-wall heat-insulating finishing material in which horizontal, vertical, and inclined patterns, and other patterns which are positioned adjacent to the upper and lower portions of the interval plate, are engraved on the surface of the heat-insulating material, allowing the tiles to remain firmly attached for a long time without deformation.

Another object of the present invention is to provide an outer-wall heat-insulating finishing material in which crossing nodes are formed deeper than the engraved patterns at the crossings of the engraved patterns, allowing the tiles to be more securely attached against strong external forces.

The present invention comprises a heat-insulating material 100 fastened to a wall surface 10, plurality of interval plates 200 formed in parallel with each other at an interval corresponding to a height of a tile 400 to be thinner than a thickness of the tile 400, and a pattern part 300 engraved on a surface of the heat-insulating material 100 to attach the tile 400 in a maximized force of attachment, wherein the tile 400 is fitted between the interval plates 200, wherein mortar 500 is applied to the surface of the heat-insulating material 100, the pattern part 300, and tips of the interval plates 200 to attach the tile 400 to the surface of the heat-insulating material 100.

According to the present invention, the interval plates 200 have a plurality of spacing parts 210 at an interval corresponding to a length of the tile 400, wherein the tile 400 is fitted between the interval plates 200 while being spaced from another tile 400 by the spacing parts 210, wherein the mortar 500 is applied to the spacing parts 210 to allow the tile 400 to be attached to the surface of the heat-insulating material 100 while being connected with tiles 400 adjacent thereto in an upper, lower, left, and right direction.

According to the present invention, an inclined, chamfered portion 220 is formed in each of upper and lower portions of a tip of each interval plate 200, wherein the chamfered portion 220 increases an area of contact with the mortar 500 to allow the tile 400 to be attached to the surface of the heat-insulating material 100 in an increased area where the tile 400 attaches to the interval plates 200.

According to the present invention, the pattern part 300 is any one selected from a shape in which circles crossing each other are formed and a shape in which triangles are formed continuously.

According to the present invention, a ratio of a thickness (a) of each interval plate 200 to a length (b) of the chamfered portion 220 to a thickness (c) of the tile 400 protruding from the tips of the interval plates 200 is 2:1:1.

According to the present invention, the pattern part 300 further includes a plurality of polygonal patterns 360 thereinside, and wherein the mortar 500 is applied to the polygonal patterns 300 to attach the tile 400 to the surface of the heat-insulating material 100.

According to the present invention, the pattern part 300 further includes a proximate pattern 310 formed adjacent, and in parallel, to each of an upper portion and a lower portion of each interval plate 200 on the surface of the heat-insulating material 100, wherein the mortar 500 is applied to the proximate pattern 310 to provide a more grip for the upper and lower portions when the tile 400 is attached to the surface of the heat-insulating material 100.

According to the present invention, the pattern part 300 further includes a horizontal pattern 320 formed horizontally, a vertical pattern 330 formed vertically, and an inclined pattern 340 formed inclinedly on the surface of the heat-insulating material 100 to allow the tile 400 to be more securely attached against external forces acting in a horizontal, vertical, and inclined direction.

According to the present invention, the proximate pattern 310, the horizontal pattern 320, the vertical pattern 330, and the inclined pattern 340 of the pattern part 300 are formed to cross each other, wherein the pattern part 300 further includes crossing nodes formed deeper than the proximate pattern 310, the horizontal pattern 320, the vertical pattern 330, and the inclined pattern 340 at intersections of the patterns to allow the tile 400 to be more securely attached against strong external forces acting to the tile 400.

According to the present invention, the tiles 400 may be arranged at constant intervals while being spaced from each other when fitted and fastened between the interval plates 200 via the spacing parts 210 of the interval plates 200. The mortar 500 is applied to the upper, lower, left, and right sides surfaces, as well as the bottoms, of the the tiles 400 spaced apart, and the tiles 400 are attached to the front surface 110 of the heat-insulating material 100 with the adjacent tiles 400 connected in the upper, lower, left, and right directions, allowing the tiles 400 to be strongly attached to the front surface 110 in a further secure manner.

According to the present invention, the inclined chamfered portions 220 are formed in the upper and lower portions of the tip of the interval plate 200, maximizing the area of contact between the mortar 500 and the upper and lower portions of the tile 400 when the tile 400 is attached to the front surface 110 of the heat-insulating material 100 and giving a reinforced grip for the tile 400.

The pattern part 300 is engraved, including the horizontal pattern 320 formed horizontally, the vertical pattern 330 formed vertically, and the inclined pattern 340 formed inclinedly on the front surface 110 of the heat-insulating material 100, allowing the tile 400 to be more securely attached to the front surface 110 of the heat-insulating material 100 against forces acting in the horizontal, vertical, and inclined directions.

According to the present invention, the proximate pattern 310 is engraved on the front surface 110 of the heat-insulating material 100 to be formed adjacent, and in parallel, to each of the upper and lower portions of the interval plate 200. When the tile 400 is fitted between the interval plates 200, the mortar 500 is applied to the proximate pattern 310 to give an increased grip for the tile 400 when the tile 400 is attached to the surface of the heat-insulating material 100, fundamentally preventing the tile 400 from escaping off.

According to the present invention, the crossing nodes 350 are engraved deeper than the proximate pattern 310, the horizontal pattern 320, the vertical pattern 330, and the inclined pattern 340 at the points where the proximate pattern 310, the horizontal pattern 320, the vertical pattern 330, and the inclined pattern 340 cross each other, allowing the tile 400 to be more securely attached to the front surface 110 of the heat-insulating material 100 against strong external forces.

DESCRIPTION OF EXEMPLARY EMBODIMENTS

Hereinafter, preferred embodiments of the present invention are described with reference to the accompanying drawings to be easily practiced by one of ordinary skill in the art.

Figure 1:
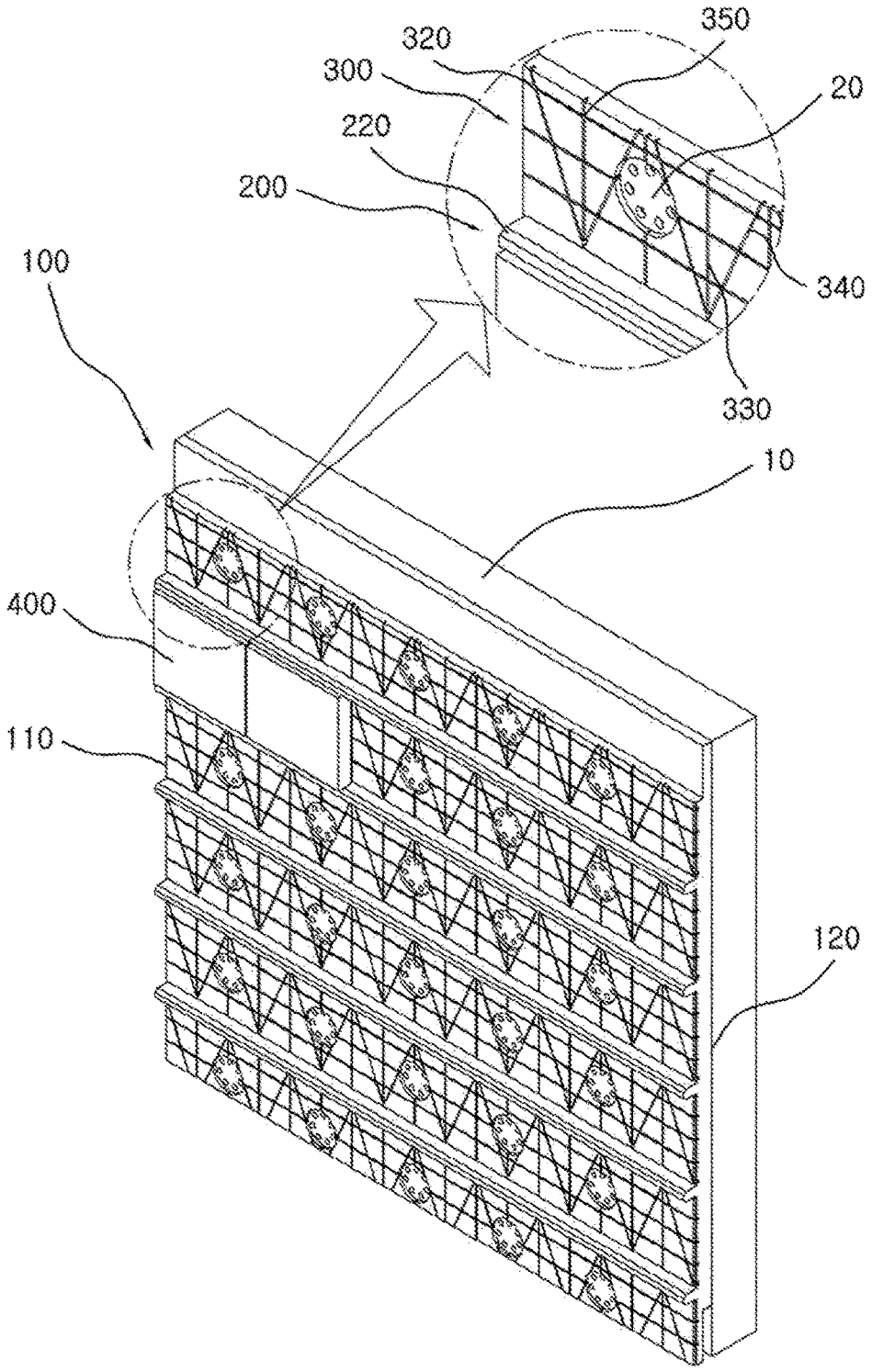
FIG. 1 is a perspective view illustrating an outer-wall heat-insulating finishing material according to an embodiment of the present invention.
Figure 2:
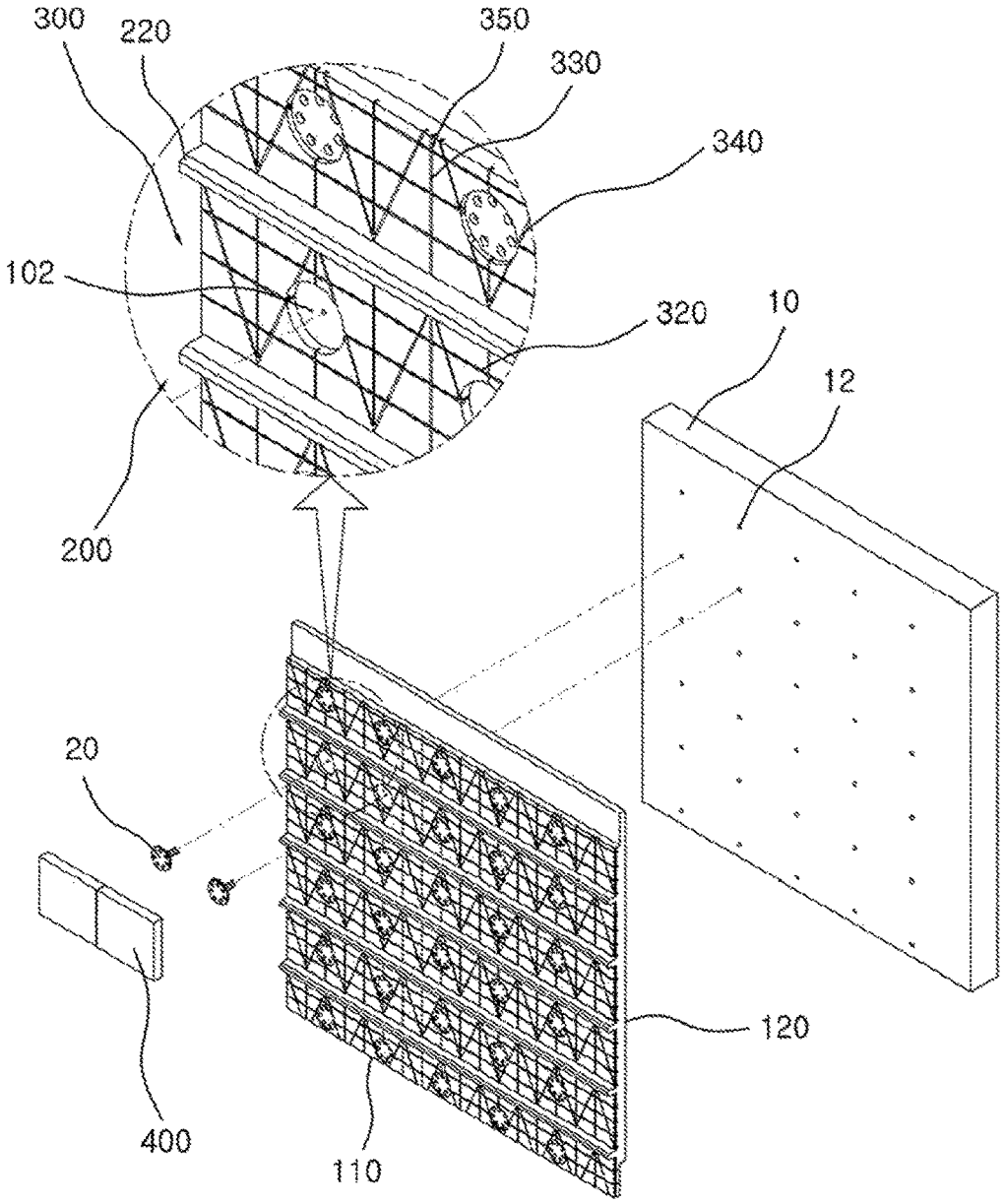
FIG. 2 is an exploded perspective view illustrating an outer-wall heat-insulating finishing material according to an embodiment of the present invention.
Figure 3:
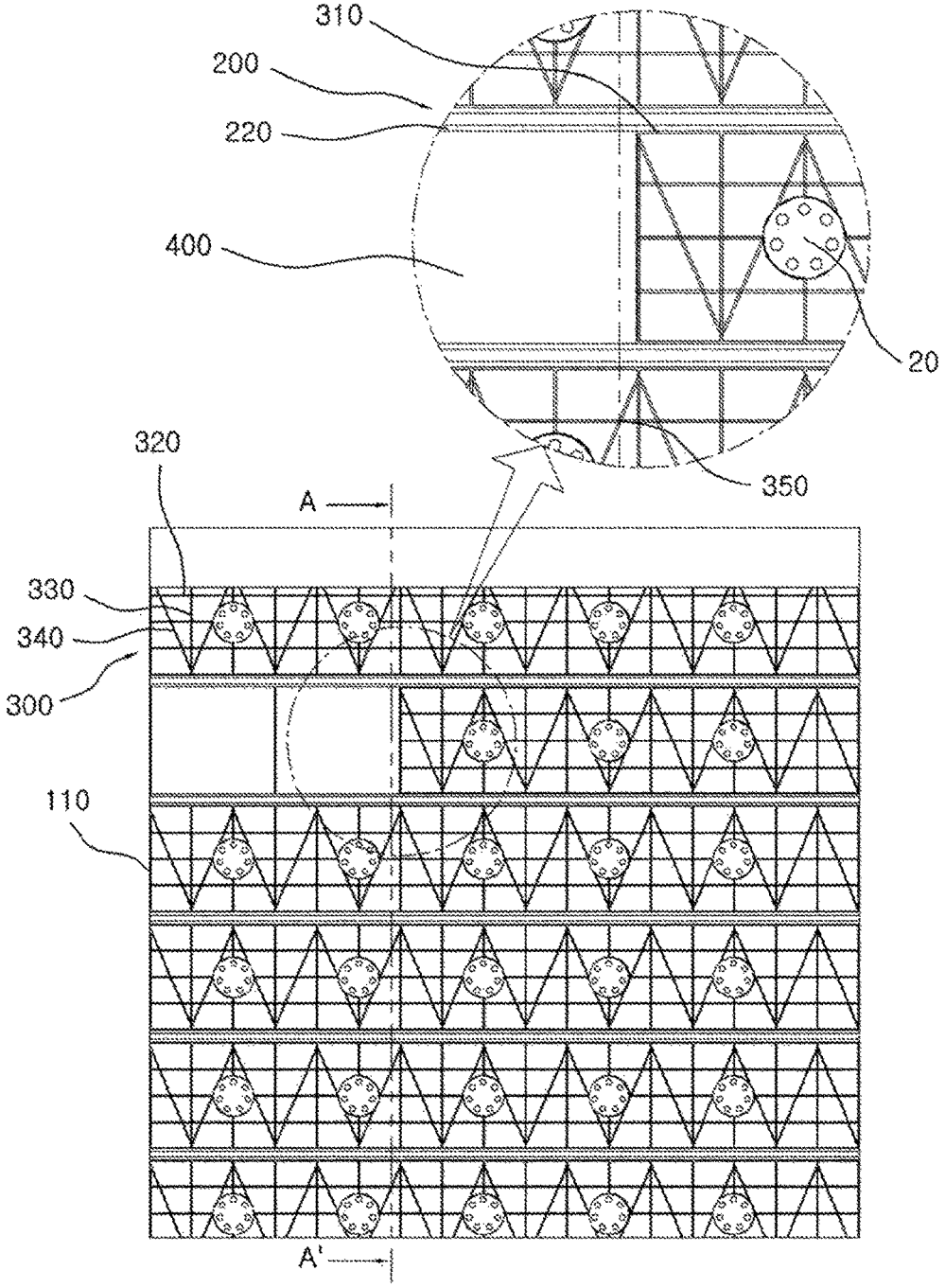
FIG. 3 is a front view illustrating an outer-wall heat-insulating finishing material according to an embodiment of the present invention.
Figure 4:
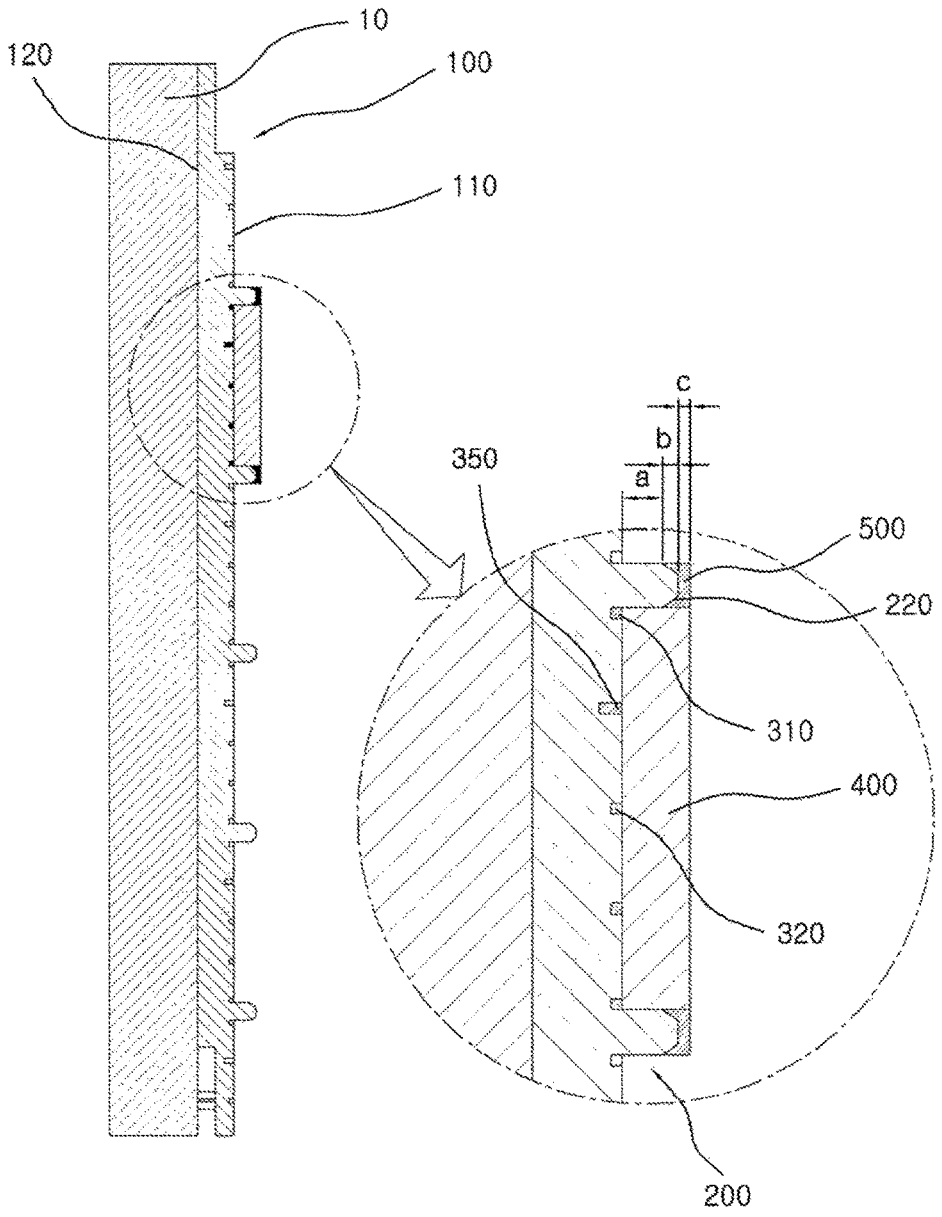
FIG. 4 is a cross-sectional view taken along line A-A' of FIG. 3.

FIG. 1 is a perspective view illustrating an outer-wall heat-insulating finishing material according to an embodiment of the present invention. FIG. 2 is an exploded perspective view illustrating an outer-wall heat-insulating finishing material according to an embodiment of the present invention. FIG. 3 is a front view illustrating an outer-wall heat-insulating finishing material according to an embodiment of the present invention. FIG. 4 is a cross-sectional view taken along line A-A' of FIG. 3.

Referring to FIGS. 1 to 4, an outer-wall heat-insulating finishing material according to an embodiment of the present invention includes a heat-insulating material 100 fastened to a wall surface 10, interval plates 200 formed on the heat-insulating material 100, and a pattern part 300 engraved in the heat-insulating material 100.

The wall surface 10 may be an outer or inner wall of a building. The heat-insulating material 100 is attached to the wall surface 10, and tiles 400 are attached to an outer surface of the heat-insulating material 100, increasing the heat insulation of the building and the strength of the wall surface 10 while decorating the surface of the heat-insulating material 100.

The wall surface 10 may be any type of surface where the heat-insulating material 100 may be installed. Meanwhile, a plurality of fastening holes 12 are formed in the wall surface 10 to be able to fasten fasteners 20. The fasteners 20 may be inserted and fastened to the fastening holes 12 to fasten the heat-insulating material 100 to the wall surface 10.

The heat-insulating material 100 is used to insulate the wall surface 10. The heat-insulating material 100 may be formed of expanded polystyrene (EPS). The heat-insulating material 100 may be replaced with glass wool, extruded polystyrene, or rubber form insulation.

The heat-insulating material 100 is shaped and sized corresponding to the wall surface 10. A rear surface 120 of the heat-insulating material 100 is attached to the wall surface 10. A plurality of insertion holes 102 are formed in the heat-insulating material 100 for installation of the fasteners 20. The fasteners 20 are inserted into the insertion holes 102, with the rear surface 120 of the heat-insulating material 100 coming in tight contact with the wall surface 10, and the fasteners 20 are installed in the fastening holes 12 formed in the wall surface 10, thereby securing the heat-insulating material 100 to the wall surface 10.

Tiles 400 are attached onto the front surface 110 of the heat-insulating material 100 via mortar 500. A plurality of interval plates 200 are formed on the front surface 110 to be spaced apart from each other by the height of the tile 400. The interval plates 200 may make pairs each of which includes two interval plates 200 positioned in parallel with each other and spaced from each other by an interval corresponding to the height of the tile 400. The interval 200 between the paired interval plates 200 has a tolerance to allow the tiles 400 to be smoothly fitted and fastened therebetween.

The pattern part 300 is engraved in the front surface 110 to securely attach the tiles 400. The mortar 500 is applied to the pattern part 300, and the tiles 400 are securely attached to the front surface 110 by the mortar 500. In other words, while the mortar 500 is applied to the overall front surface 110 of the heat-insulating material 100, the mortar 500 is also applied to the pattern part 300, allowing the tiles 400 to be securely fastened in tight contact with the front surface 110 while being fitted between the interval plates 200.

The interval plates 200 protrude from the front surface 110 of the heat-insulating material 100. The length at which the interval plates 200 protrude may be shorter than the thickness of the tiles 400. The interval plates 200 may be formed in pair to have an interval corresponding to the height of the tile 400. The plurality of interval plates 200 are formed on the front surface 110 to be spaced apart from each other by the height of the tile 400.

The tiles 400 are fitted and fastened between the interval plates 200. The bottoms of the tiles 400 are securely attached by the mortar 500 applied to crossing nodes 350 and the pattern part 300 formed in the front surface 110. The tiles 400 protrude beyond the tips of the interval plates 200 in the position of having been attached to the front surface 110.

Meanwhile, chamfered portions 220 are formed in the upper and lower portions of the tip of each interval plate 200. The chamfered portions 200 are inclined upper and lower portions of the tip of each interval plate 200, allowing the maximized contact area between the chamfered portions 200 and the mortar 500 when the tiles 400 are fastened between the interval plates 200.

In other words, forming the chamfered portions 220 in the tip of each interval plate 200 increases the area of contact with the mortar 500, allowing the mortar 500 applied to the tips of the interval plates 200 to more securely fasten the tiles 400 at both sides of each tile 400. That is, the area where the tiles 400 contact the interval plates 200 increases, attaching the tiles 400 more securely.

Referring to FIG. 4, which is an expanded view, when the thickness of the interval plate 200 is a, the length of the chamfered portion 220 is b, and the thickness of the tile 400 projecting beyond the thickness of the interval plate 200 is c, the thickness of the interval plate 200 and the length of the chamfered portion 220 may be optimally set with respect to the thickness of the tile 400. The ratio of a:b:c is preferably set to 2:1:1 to increase to the maximum the area of attachment of the interval plate 200 for the tile 400.

The pattern part 300 is a set of cuts formed in the front surface 110 of the heat-insulating material 100. The pattern part 300 includes a proximate pattern 310 formed to abut the interval plate 200, a horizontal pattern 320 formed horizontally, a vertical pattern 330 formed vertically, and an inclined pattern 340 formed inclinedly.

The proximate pattern 310 is a cut formed to about the upper and lower portion of the interval plate 200 along a straight line, serving to securely attach the tile 400 at the upper and lower portions of the tile 400 when the mortar 300 is applied to the proximate pattern 310 to attach the tile 400 between the interval plates 200. In other words, the proximate pattern 310 allows the tile 400 to remain securely attached against external forces that may act to the upper and lower portions.

The tile 400 may escape from the front tile 110 starting from its upper and lower edges. The proximate pattern 310 firmly holds the upper and lower edges of the tile 400, preventing the tile 400 from escaping off the front surface 110. In other words, the proximate pattern 310 reinforces the attachment at the upper and lower portions, fundamentally preventing the tile 400 from escaping off.

A plurality of horizontal patterns 320 are horizontally spaced from each other at an interval between the interval plates 200. The horizontal patterns 320 allow the tile 400 to be securely attached to the front surface 110 against external forces that are horizontally exerted to the tile 400.

A plurality of vertical patterns 330 are vertically spaced from each other at an interval between the interval plates 200. The vertical patterns 330 allow the tile 400 to be securely attached to the front surface 110 against external forces that are vertically exerted to the tile 400.

A plurality of inclined patterns 340 are inclinedly formed between the interval plates 200. The inclined patterns 340 allow the tile 400 to be securely attached to the front surface 110 against external forces that are inclinedly exerted to the tile 400.

Thus, the tiles 400 may be attached to the front surface 110 of the heat-insulating material 100 against forces that may play horizontally, vertically, or inclinedly.

Crossing nodes 350 are formed at the intersections of the proximate pattern 310, horizontal patterns 320, vertical patterns 330, and inclined patterns 340 of the pattern part 300. The crossing nodes 350 are formed about 1 mm to about 5 mm deeper than the proximate pattern 310, horizontal patterns 320, vertical patterns 330, and inclined patterns 340. The crossing nodes 350 play a role to increase the attachment of the tiles 400. In other words, the crossing nodes firmly and constantly hold the tiles 400 and increase the strength of attachment of the tiles 400 against external impacts, such as an earthquake.

The tiles 400 may be small and thin porcelain or ceramic plates and are attached to the front surface 110 of the heat-insulating material 100 for decoration purposes. The height of the tile 400 corresponds to the interval between the interval plates 200. The tiles 400 are securely fastened by the mortar 500 applied to the tips of the interval plates 200 and the pattern part 300 while being fitted and fastened between the interval plates 200.

The mortar 500 is the plaster of lime, cement, sand, and water. The mortar 500 is applied to the tips of the interval plates 200 and the pattern part 300 formed on the rear surface of the heat-insulating material 100, securely fastening the tiles 400. The mortar 500 is hardened as water evaporates over time, securing the tiles 400 to the front surface 110 of the heat-insulating material 100.

Figure 5:
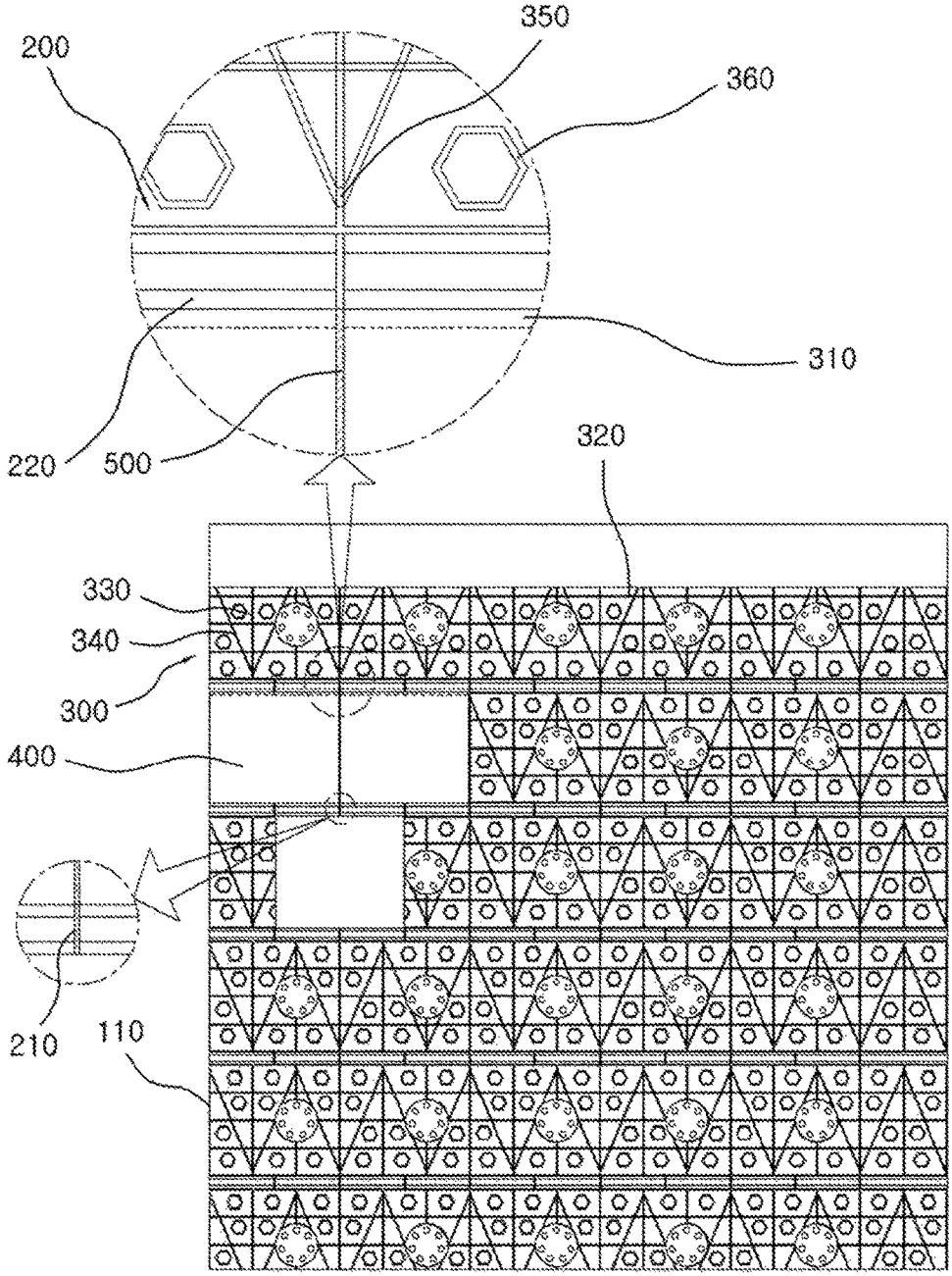
FIG. 5 is a front view illustrating an outer-wall heat-insulating finishing material in which spacing parts 210 are formed in an interval plate 200 according to an embodiment of the present invention.

FIG. 5 is a front view illustrating an outer-wall heat-insulating finishing material in which spacing parts 210 are formed in an interval plate 200 according to an embodiment of the present invention.

The interval plate 200 has a plurality of spacing parts 210 formed at even intervals. The interval between spacing parts 210 is provided to correspond to the length of the tile 400. The interval plate 200 is divided by the spacing part 210 so that the length of one tile 400 corresponds to the two parts of the interval plate 200. In other words, the length of one tile 400 corresponds to the two parts of the interval plate 200 and the spacing part 210 positioned at the center of the interval plate 200. Thus, the tiles 400 may be arranged so that the upper tiles and the lower tiles 400 separated by the interval plate 200 overlap each other by half.

As shown in FIG. 5, the two upper tiles 400 are arranged, and the lower tiles 400 are arranged to overlap by half the upper tiles 400. The mortar 500 is applied between the upper tiles 400 and the lower tiles 400, securely attaching the tiles 400.

In other words, the plurality of tiles 400 are fitted and fastened between the interval plates 200 while being spaced adjacent from each other at constant intervals so that the upper tiles 400 and the lower tiles 400 are alternately arranged to overlap by half.

In this state, the mortar 500 is applied to the upper, lower, left, and right sides surfaces and bottoms of the tiles 400 spaced apart, and the tiles 400 are attached to the front surface 110 of the heat-insulating material 100 with the adjacent tiles 400 connected in the upper, lower, left, and right directions, allowing the tiles 400 to be strongly attached to the front surface 110.

A polygonal pattern 360 is engraved on the front surface 110 of the heat-insulating material 100. The polygonal pattern 360 is formed not to overlap the proximate pattern 310, the horizontal patterns 320, the vertical patterns 330, and the inclined patterns 340 described above. In other words, the polygonal pattern 360 is formed inside a pattern or shapes formed by a combination of the proximate pattern 310, the horizontal patterns 320, the vertical patterns 330, and the inclined patterns 340.

The polygonal pattern 360 plays a role to give better adhesion for the tiles 400 when the tiles 400 are attached to the front surface 110.

Figure 6:
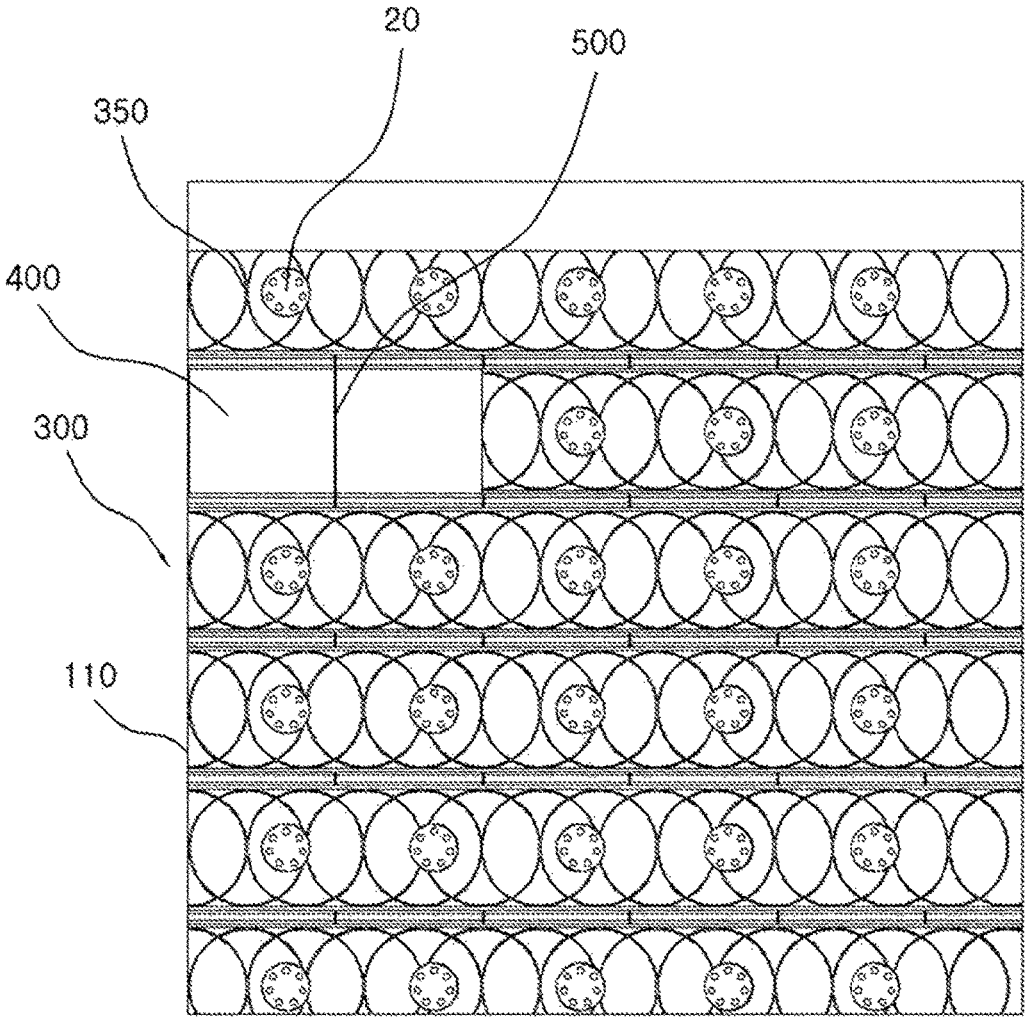
FIG. 6 is a front view illustrating an outer-wall heat-insulating finishing material with a pattern part 300 of a different shape according to an embodiment of the present invention.

FIG. 6 is a front view illustrating an outer-wall heat-insulating finishing material with a pattern part of a different shape according to an embodiment of the present invention.

The pattern part 300 may be formed in circles overlapping each other as shown in FIG. 6 or in continuous triangles as shown in FIG. 5. In other words, various shapes may apply to the pattern part 300 formed in the front surface 110. Crossing nodes 350 are formed at the intersections of the patterns of the pattern part 300.

Meanwhile, any type of pattern part 300, e.g., a combination of polygons, a geometrical pattern, or a mix of patterns, may be formed as long as it enables the tiles 400 to be, or remain, securely attached.

[Description of Symbols]

| | | |
|---|---|---|
| 10: wall surface | 12: fastening hole | |
| 20: fastener | | |
| 100: heat-insulating material | | |
| 102: insertion hole | | |
| 110: front surface | 120: rear surface | |
| 200: interval plate | | |
| 210: spacing part | 220: chamfered portion | |
| 300: pattern part | | |
| 310: proximate pattern | 320: horizontal pattern | 330: vertical pattern |
| 340: inclined pattern | 350: crossing node | 360: polygonal pattern |
| 400: tile | | |
| 500: mortar | | |

What is claimed is:

1. An outer-wall heat-insulating finishing material, comprising:

a heat-insulating material fastened to a wall surface;

a plurality of interval plates formed in parallel with each other at an interval corresponding to a height of a tile to be thinner than a thickness of the tile; and a pattern part engraved on a surface of the heat-insulating material to attach the tile in a maximized force of attachment, wherein the tile is fitted between the interval plates, wherein mortar is applied to the surface of the heat-insulating material, the pattern part, and tips of the interval plates to attach the tile to the surface of the heat-insulating material, wherein the pattern part further includes a proximate pattern formed adjacent and in parallel to each of an upper portion and a lower portion of each interval plate on the surface of the heat-insulating material, wherein the mortar is applied to the proximate pattern to provide a more grip for the upper and lower portions when the tile is attached to the surface of the heat-insulating material, wherein the pattern part further includes a horizontal pattern formed horizontally, a vertical pattern formed vertically, and an inclined pattern formed inclinedly on the surface of the heat-insulating material to allow the tile to be more securely attached against external forces acting in a horizontal, vertical, and inclined direction, wherein the proximate pattern, the horizontal pattern, the vertical pattern, and the inclined pattern of the pattern part are formed to cross each other, wherein the pattern part further includes crossing nodes formed deeper than the proximate pattern, the horizontal pattern, the vertical pattern, and the inclined pattern at intersections of the patterns to allow the tile to be more securely attached against strong external forces acting to the tile.

2. The outer-wall heat-insulating finishing material of claim 1, wherein the interval plates have a plurality of spacing parts at an interval corresponding to a length of the tile, wherein the tile is fitted between the interval plates while being spaced from another tile by the spacing parts, wherein the mortar is applied to the spacing parts to allow the tile to be attached to the surface of the heat-insulating material while being connected with tiles adjacent thereto in an upper, lower, left, and right direction.

3. The outer-wall heat-insulating finishing material of claim 1, wherein an inclined, chamfered portion is formed in each of upper and lower portions of a tip of each interval plate, wherein the chamfered portion increases an area of contact with the mortar to allow the tile to be attached to the surface of the heat-insulating material in an increased area where the tile attaches to the interval plates.

4. The outer-wall heat-insulating finishing material of claim 1, wherein the pattern part is any one selected from a shape in which circles crossing each other are formed and a shape in which triangles are formed continuously.

5. The outer-wall heat-insulating finishing material of claim 3, wherein a ratio of a thickness (a) of each interval plate to a length (b) of the chamfered portion to a thickness (c) of the tile protruding from the tips of the interval plates is 2:1:1.

6. The outer-wall heat-insulating finishing material of claim 4, wherein the pattern part further includes a plurality of polygonal patterns thereinside, and wherein the mortar is applied to the polygonal patterns to attach the tile to the surface of the heat-insulating material.

7. The outer-wall heat-insulating finishing material of claim 2, wherein an inclined, chamfered portion is formed in each of upper and lower portions of a tip of each interval plate, wherein the chamfered portion increases an area of contact with the mortar to allow the tile to be attached to the surface of the heat-insulating material in an increased area where the tile attaches to the interval plates.

* * * * *